United States Patent [19]

Paquette

[11] Patent Number: 4,937,990

[45] Date of Patent: Jul. 3, 1990

[54] VENTILATION SYSTEM FOR ROOFS

[75] Inventor: Jean-Paul Paquette, St-Hilaire, Canada

[73] Assignee: SIBO, Inc., Canada

[21] Appl. No.: 385,971

[22] Filed: Jul. 27, 1989

Related U.S. Application Data

[63] Continuation of Ser. No. 96,697, Sep. 15, 1987, abandoned.

[30] Foreign Application Priority Data

Mar. 6, 1987 [CA] Canada ..... 531417

[51] Int. Cl.[5] ..... E04B 7/00

[52] U.S. Cl. ..... 52/199; 52/404; 52/408

[58] Field of Search ..... 52/404

[56] References Cited

U.S. PATENT DOCUMENTS

| | | | |
|---|---|---|---|
| 3,053,716 | 9/1962 | Finan | 52/302 X |
| 3,094,447 | 6/1963 | Chamberlain | 52/309.8 X |
| 3,135,069 | 6/1964 | Schuller et al. | 52/302 |
| 3,339,325 | 9/1967 | Knapp | 52/309.4 |
| 3,387,420 | 6/1968 | Long | 52/302 |
| 3,619,961 | 11/1971 | Sterrett et al. | 52/302 |
| 3,971,184 | 7/1976 | Van Wagoner | 52/408 X |
| 4,114,335 | 9/1978 | Carroll | 52/302 X |
| 4,274,239 | 6/1981 | Carroll | 52/282 X |
| 4,449,336 | 5/1984 | Kelly | 52/105 |
| 4,489,531 | 12/1984 | Nelson | 52/303 X |
| 4,492,064 | 1/1985 | Bynoe | 52/309.8 |
| 4,507,901 | 4/1985 | Carroll | 52/404 X |
| 4,530,193 | 7/1985 | Ochs | 52/408 |
| 4,538,388 | 9/1985 | Friesen | 52/199 |
| 4,658,554 | 4/1987 | Riley et al. | 52/309.8 |
| 4,669,246 | 6/1987 | Freeman | 52/408 |
| 4,674,249 | 6/1987 | Bennett, Jr. | 52/302 |
| 4,707,961 | 11/1987 | Nunley et al. | 52/408 |

FOREIGN PATENT DOCUMENTS

| | | | |
|---|---|---|---|
| 1816577 | 6/1970 | Fed. Rep. of Germany | 52/199 |
| 2742444 | 3/1979 | Fed. Rep. of Germany | 52/408 |
| 417008 | 1/1967 | Switzerland | 52/303 |
| 775258 | 10/1980 | U.S.S.R. | 52/199 |
| 961133 | 6/1964 | United Kingdom | 52/302 |

*Primary Examiner*—Carl D. Friedman
*Assistant Examiner*—Jerrold D. Johnson
*Attorney, Agent, or Firm*—Joseph G. Seeber

[57] ABSTRACT

The present invention relates to a ventilation system which makes the drying of roof insulation easier when there is a break in the vapor barrier or in the impermeable membrane protecting the said insulation. The system comprises an impermeable sheet composed of a series of openings distributed on its surface and a plurality of supports arranged between the openings.

29 Claims, 4 Drawing Sheets

VENTILATION SYSTEM FOR ROOFS

This application is a continuation of application Ser. No. 096,697, filed Sept. 15, 1987, now abandoned.

FIELD OF THE INVENTION

The present invention relates to a ventilation system which makes the drying of roof insulation easier when there is a break in the vapor barrier or in the water impermeable membrane protecting the said insulation.

DESCRIPTION OF PRIOR ART

Among the insulation materials available for building a roof, a large part of the market is occupied by the closed-cell expanded plastics and the mineral fibre panels.

These two types of insulation material present good thermal properties, the choice of one over the other is often made in consideration of factors such as the purchase price, the furture wear of the material and the ease with which the material can be handled on the building site.

During the construction of a flat roof, in addition to the use of one of the above described insulation materials, we proceed to the installation of a vapor barrier for the purpose of stopping the infiltration of water vapor which may come from the inside of the building, and we proceed with the installation of an impermeable membrane resistant to the infiltrations in order to protect the insulation from exterior conditions.

When the said membrane breaks for one reason or another, the roof becomes soaked with water and its insulating properties are greatly affected. Furthermore, if for any reason, the vapor barrier is broken, the accumulation of water vapor penetrating the insulation greatly affects its thermal resistance.

The roofs on steel deck bridge are normally built according to the following steps:

(1) Installation of fire resistant gypsum panels on a steel deck (screwed).

(2) Installation of an impermeable vapor barrier on the gypsum panels (glued with adhesive or asphalt).

(3) Installation of a rigid insulation material composed of fiber glass covered on top by asphaltic paper; the panel is placed in a full surface bed of asphalt on the vapor barrier with the asphaltic paper on top in order to receive the next rigid insulation panel (if necessary) or the protective panel described hereunder.

(4) Installation of a grooved wood fiber protective cover (the panel is laid down on a full surface bed of asphalt on the insulation panels).

(5) Installation of a multi-layered full surface asphaltic membrane on the wood fiber protective panel.

This construction confines the insulation and the wood fiber panel between the vapor barrier and an impermeable membrane. In addition, it confines the water vapors, the moisture and the water which is able to seep in during the building or following a break in the vapor barrier or the membrane.

When the water or the accumulated water vapor inside the insulation expands, a pressure is created under the membrane often causing a premature deterioration affecting its water-tightness. To solve this problem, one must remove the membrane, the insulation and the vapor barrier and replace them with new materials.

A solution to this problem is presented in U.S. Pat. No. 4,492,064 (BYNOE). This patent presents a canalization system and a drain integrated to the roof.

To obtain this result, Bynoe uses a closed-cell expanded plastic which he molds in squares in a way which allows water to be canalized to the roof drains. By the use of a closed-cell expanded plastic, the latter being itself impermeable, the impermeable membrane covering the roof may be eliminated. Because the insulation cannot be soaked with water and as the water will be evacuated rapidly by the drains, the insulating properties of the roof are relatively well preserved despite the presence of water.

Unfortunately, mineral fiber insulation does not have the same impermeable property as closed-cell expanded insulation and requires, to insure its protection, means to prevent water from coming into contact with the insulation. The traditional means consists of an impermeable membrane on each side of the insulation.

If theoretically, a 100 percent impermeable membrane is possible, in practice, we see that, in general, these membranes are perforated or are damaged rapidly and they do not assure their protective role. On the contrary, these membranes can keep the water infiltration inside of the roof, causing the loss of the insulating properties of the roof.

OBJECTS OF THE INVENTION

An object of the present invention is to create a ventilated roof system ensuring the draining of the mineral fiber insulation or other material which may retain or absorb the moisture when the impermeable membrane is damaged or imperfect.

A second object of the present invention is to allow the roofer to remove the existing membrane after its like span and to replace it without the need to replace the ventilation panel, the insulation and the vapor barrier. The whole remaining in place ready to receive the new membrane.

A third object of this invention is to allow the construction of a membrane fastened with nails to the panel of the ventilated support according to known techniques.

Another object of this invention is to provide the construction industry with a panel usable on the building site allowing the realization of such ventilated roofing system.

These objects will be realized by a panel comprising:

(a) A sheet made with an impermeable material placed on the mineral fibre insulation or other material capable of holding or absorbing the moisture from the said insulation panel to an air space, and (b) A number of supports equally spread over the said perforated sheet, which supports are used to create an air space and a canalization pattern capable of conducting the moisture contained in the insulation panel towards air outlets arranged at different locations and preferably on the roof periphery.

The said supports may be present in various shapes and dimensions and must be capable of transferring the load supported by the roof to the insulation which will in turn transfer it to the rest of the structure.

BRIEF DESCRIPTION OF THE DRAWINGS

The present invention will now be described with the help of two (2) examples as well as the following figures.

DESCRIPTION OF THE PREFERRED-EMBODIMENTS OF THE INVENTION

Figure 1:
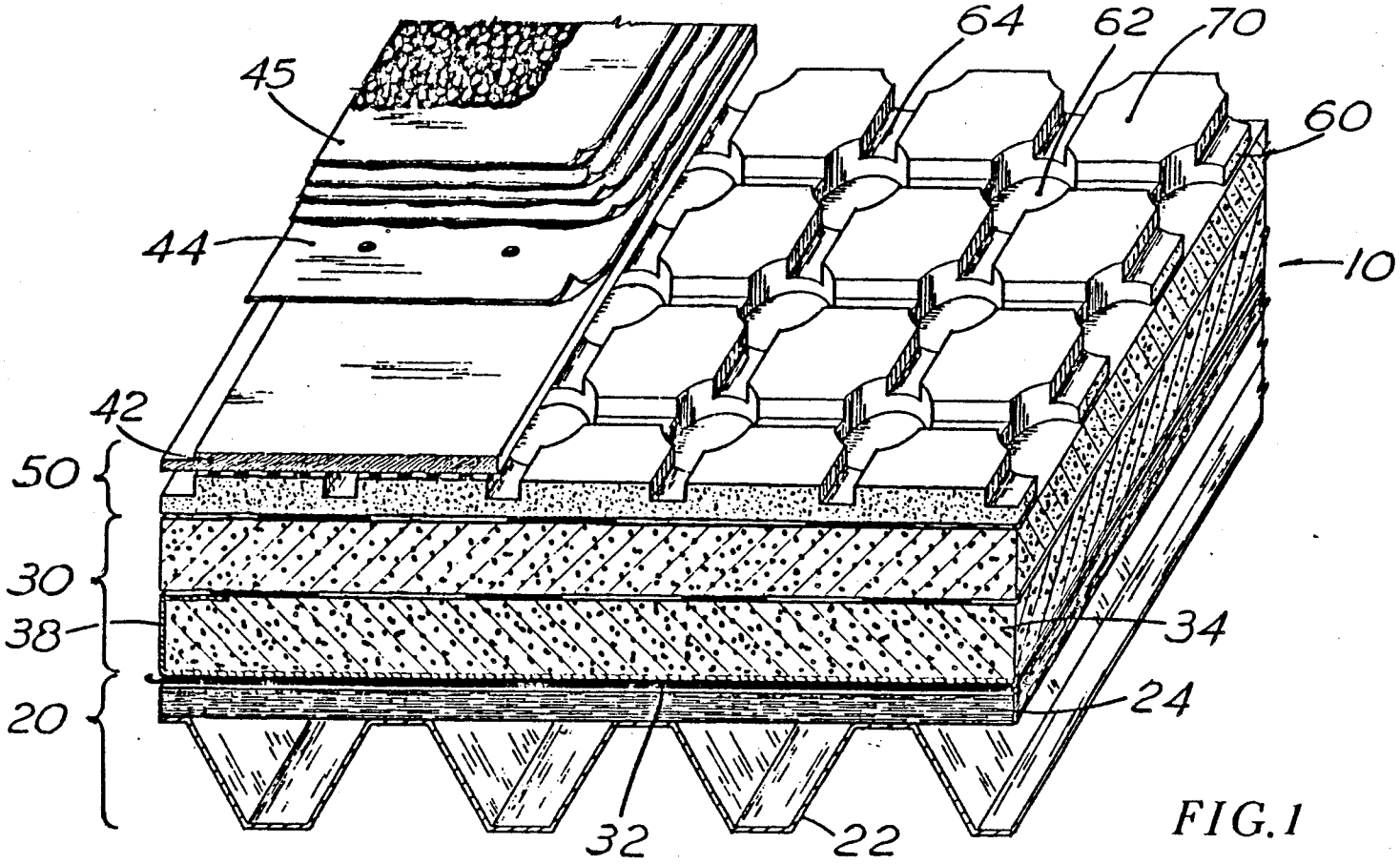
FIG. 1 represents a view in perspective of the roofing system embodying the present invention.
Figure 2:
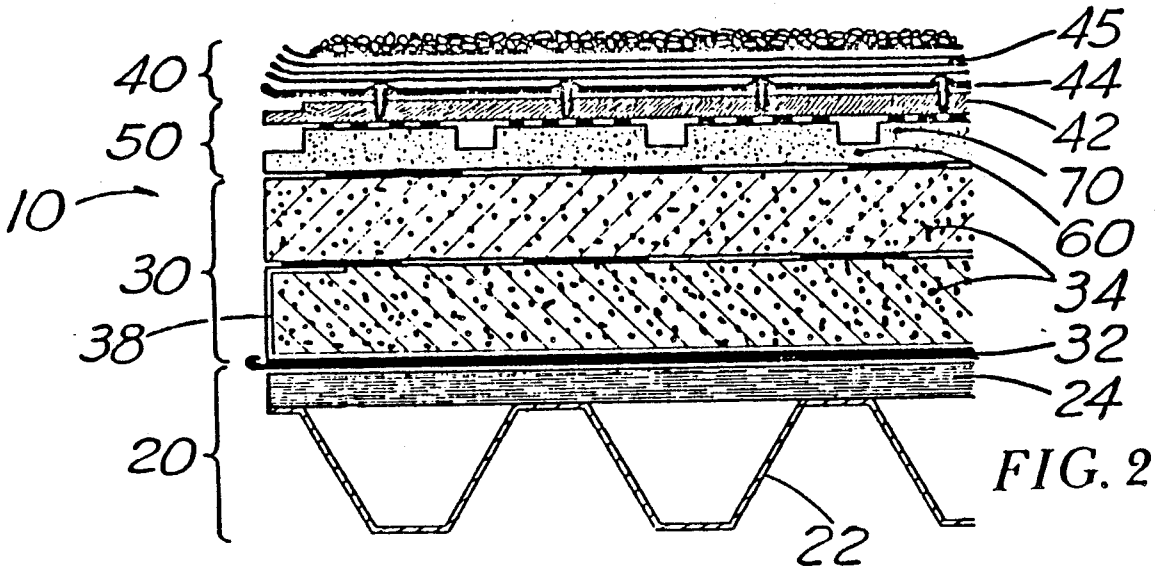
FIG. 2 represents a sectional view embodying the invention illustrated in FIG. 1.

As presented in FIGS. 1 to 4, a roofing system 10 is generally made up of the following elements:

(a) A basic structure 20 comprising, for example, a metal deck 22 and a rigid panel 24 (for example fire-resistant gypsum panel);

(b) An insulating layer 30, made up of a vapor barrier 32 which is in contact with the basic structure 20 and of one or more insulation layers 34 (for example, pressed inorganic mineral fiber panels), the said vapor barrier 32 having the function of stopping the progression of the moisture from the inside of the building towards the insulation layer 34;

(c) A ventilation system 50;

(d) An impermeable membrane 40.

Furthermore, the insulation panels forming the lower layer 34 may be covered by a covering 38 (placed on the top in the conventional roofs) which, even if their function is to preserve the form of the insulation panel, also constitutes a supplementary vapor barrier.

A roof embodying this method but without the ventilation system 50 is able to assure a thermal insulation for the building as long as the water impermeable membrane 40 or the "vapor barrier" 32 are not broken.

When a break occurs to the said impermeable membrane 40, the insulation becomes, in a restricted area, after a shower or melting of snow, impregnated with water vapor and therefore no longer offers the same thermal insulation coefficient. The water which cannot be evacuated will be transformed into water vapor or moisture which will spread throughout the entire roofing insulation layer rather than being confined in an area surrounding the zone where the break of the water impermeable membrane occurred.

The use of a ventilation system 50 built in accordance with the present invention allows, in a case of infiltration after damage to the membrane, that the insulating layer be rapidly drained. However, it is necessary that there be no covering on the rigid insulation layer or that such a covering be placed on the lower surface of the insulation layer in order not to block the circulation of moisture inside the roof.

The ventilation system 50 is composed of the following:

(a) A ventilated support panel 60 preferably made of impermeable material comprising a series of openings 62 distributed uniformly over the entire surface of said panel 60 and a number of supports (70 in the FIGS. 1 and 2, 170 in FIGS. 3 and 4) which can be of varied shapes and dimensions arranged uniformly over the entire surface of said panel 60, which supports are used to form an aerated space to collect the moisture or water vapor coming from the insulation layer and canalize this mositure towards the aeration outlets located in different places preferably on the periphery of the roof.

(b) A rigid panel 42 (which can be a plywood panel) which gives a support to the whole structure and allows one to circulate on the unfinished roof without damaging the structural components (insulation layer, etc.).

To allow the ventilated support panel 60 to accomplish its task to its full extent, it is necessary that the area occupied by the perforations 62 be greatly inferior to the remaining areas and that the supports 70 be capable of transferring uniformly the load supported by the roof to the insulation layer which will in turn transfer it to the rest of the structure.

The panel 60 and the supports 70 are made of a closed-cell expanded plastic sheet having, for example, one inch in thickness according to the following steps of construction: firstly, while the sheet is being molded, we add forms allowing us to obtain the canalization pattern constituted of grooves 64 having, for example, one half inch in depth by one inch in width. These grooves 64 are arranged according to two perpendicular axes to obtain a squared pattern.

In the same way, other forms are inserted inside the moulds to obtain perforations 62 at each junction having, for example, a diameter of two and a half inches. Thus, 15% of the surface is taken up by the openings, 18% by the canalization and 67% by the supports.

Figure 3:
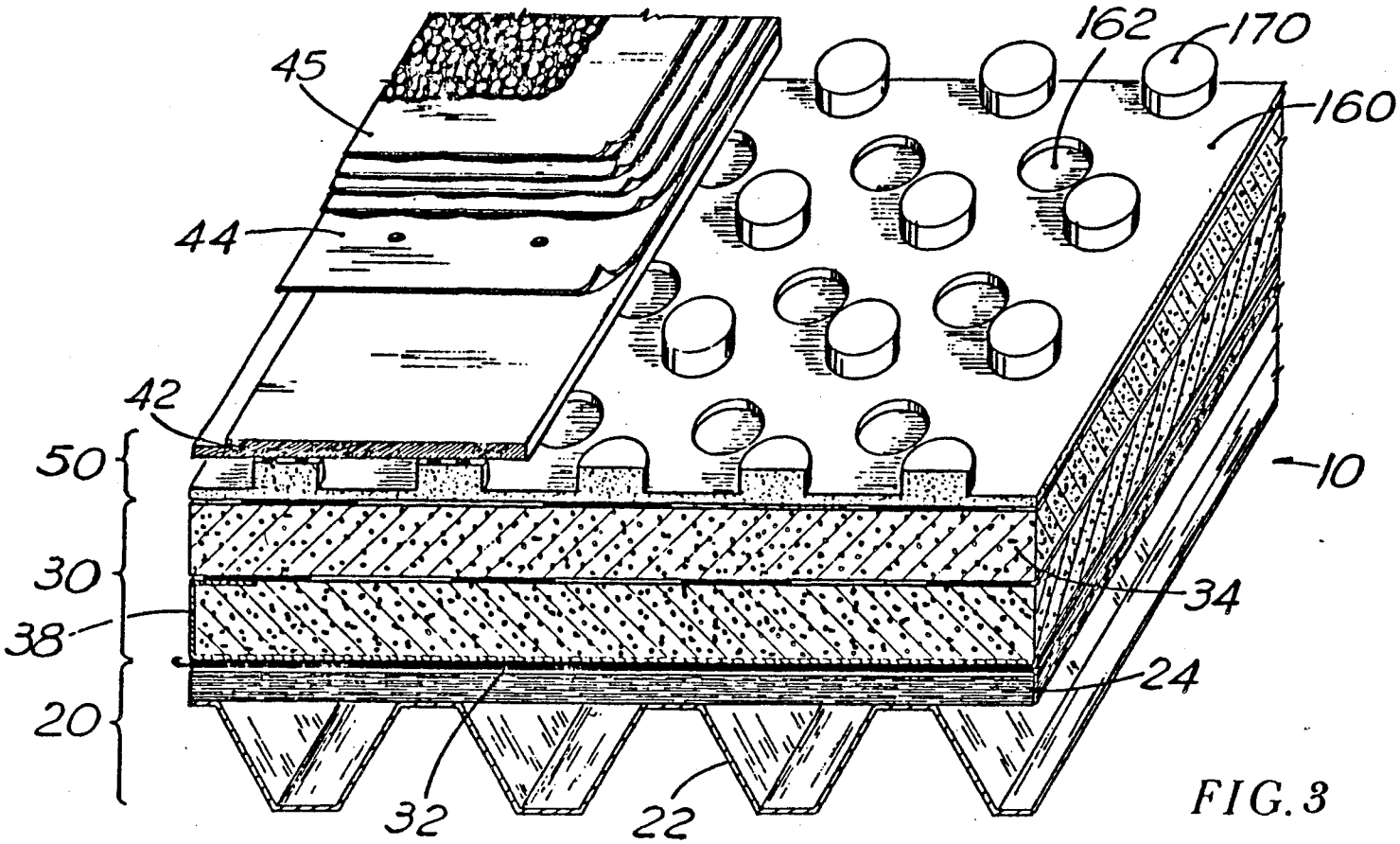
FIG. 3 represents a view in perspective showing a variation of the roof system illustrated in FIG. 1.
Figure 4:
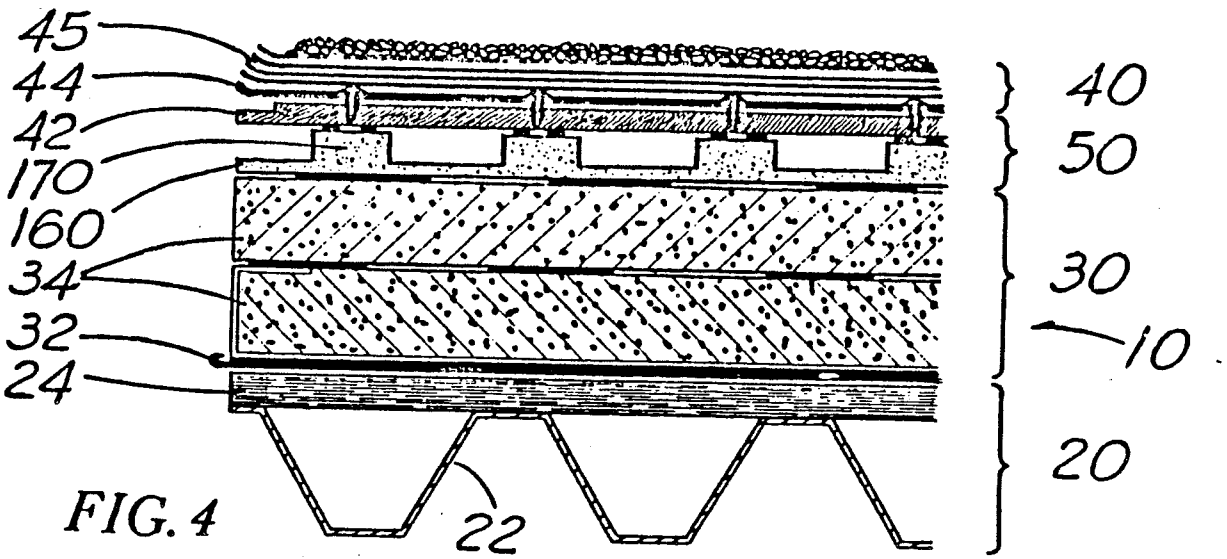
FIG. 4 represents a sectional view of the variation illustrated in FIG. 3.

FIGS. 3 and 4 represent a different embodiment of the ventilation system 50. The ventilated support panel 160 and the supports 170 may also be produced from a closed-cell expanded plastic sheet. The manufacturing process is the same as for the ventilation system illustrated in FIGS. 1 and 2, except that, in the present embodiment, the supports 170 and the holes 162 in the sheet are obtained by introducing different forms in the fabrication mould.

This embodiment could be used especially when the load applied on the roof is lighter than the one applied in the first embodiment. Thus, in this case, the percentage of the surface taken up by the supports is smaller. On the other hand, this embodiment would allow for better aeration.

It is possible to determine or to calculate which system is the most appropriate for a particular purpose.

The determination of the appropriate configuration could be made by using a table or a graph giving different shapes of supports and the arrangement of same according to the load supported by the structure.

The different components forming the roofing system are as follows:

(1) Fireproof gypsum panels 24 are screwed on the metal frame (22).

(2) The first vapor barrier 32 is installed with an adhesive or asphalt.

(3) A first insulation panel 34 is placed in a bed of asphalt.

(4) A second insulation panel 34 is glued to the first one by means of adhesive and/or asphalt strips.

(5) A ventilated support panel 60 or 160 is glued by means of adhesive applied in strips.

(6) A rigid panel 42 is installed on the ventilated support panel 60 or 160 by means of adhesive strips.

(7) A first felt 44 is then nailed on the first rigid panel and is then covered by three (3) of four (4) other felts 45 which are then placed in a full surface bed of asphalt.

It is important not to apply the adhesive on the entire surface between the two 2 insulation panels (34) or between the second insulation panel (34) and the ventilated support panels 60 or 160 because this would obstruct the ventilation passing through the components of the roof 10. Indeed, if the junction is obstructed by adhesive or a vapor barrier, the ventilation system will no longer work properly.

Even if the invention has been described with particular embodiments, it must be understood that the invention may take other forms without departing from the scope of the invention.

I claim:

1. A ventilation system for facilitating the drying of roofs, comprising:

a basic structure;

an insulation layer disposed on said basic stcruture;

a sheet disposed on top of said insulation layer, said sheet having a plurality of openings therethrough distributed over its surface; and a membrane disposed on said sheet;

wherein said plurality of openings passes from said membrane through said sheet to said insulation layer;

said system further comprising aeration outlet means connected to the openings in said sheet for facilitating the evacuation of water and moisture from the vicinity of said insulation layer;

wherein said aeration outlet means comprises a first plurality of grooves formed in said sheet and oriented in a first direction and a second plurality of grooves formed in said sheet and oriented in a second direction approximately perpendicular to said first direction, each of said first plurality of grooves intersecting a corresponding one of said second plurality of grooves at a respective one of said plurality of openings, thereby facilitating the drying of the roofs by providing a means for ventilation of said insulation layer by the removal of water and moisture from the insulation layer via said plurality of openings and said first and second pluralities of grooves.

2. A ventilation system according to claim 1, wherein the membrane is secured to said sheet with an adhesive.

3. A ventilation system according to claim 2, wherein the membrane is composed of layers of felt.

4. A ventilation system according to claim 3, wherein layers of felt are secured together by means of an adhesive.

5. A ventilation system according to claim 1, wherein the membrane is composed of layers of felt.

6. A ventilation system according to claim 5, wherein the layers of felt are secured together by means of an adhesive.

7. A ventilation system according to claim 1, wherein said aeration outlet means includes at least one peripheral opening located on a periphery of said sheet.

8. A ventilation system according to claim 1, wherein said sheet has a plurality of supports arranged between the openings.

9. A ventilation system according to claim 8, wherein the sheet and the supports are unitary.

10. A ventilation system according to claim 1, wherein said sheet is constructed from an impermeable material.

11. A ventilation system according to claim 1, wherein said membrane comprises an impermeable membrane.

12. A ventilation system according to claim 1, wherein said insulation layer comprises at least one inorganic mineral fiber panel.

13. A ventilation system according to claim 1, further comprising a fireproof member disposed between said basic structure and said insulation layer.

14. A ventilation system according to claim 13, further comprising a vapor barrier disposed between said fireproof member and said insulation layer.

15. A ventilation system according to claim 1, further comprising a vapor barrier disposed between said basic structure and said insulation layer.

16. A ventilation system according to claim 1, wherein said sheet comprises at least one closed-cell expanded plastic sheet.

17. A ventilation system for facilitating the drying of roofs, comprising:

a basic structure;

an insulation layer disposed on said basic structure;

a sheet disposed on top of said insulation layer, said sheet having a plurality of openings therethrough distributed over its surface;

protective means disposed on said sheet for protecting said sheet; and a membrane disposed on said protective means;

wherein said plurality of openings passes from said protective means through said sheet to said insulation layer;

said system further comprising aeration outlet means connected to the openings in said sheet for facilitating the evacuation of water and moisture from the vicinity of said insulation layer;

wherin said aeration outlet means comprises a first plurality of grooves formed in said sheet and oriented in a first direction and a second plurality of grooves formed in said sheet and oriented in a second direction approximately perpendicular to said first direction, each of said first plurality of grooves intersecting a corresponding one of said second plurality of grooves at a respective one of said plurality of openings, thereby facilitating the drying of the roofs by providing a means for ventilation of said insulation layer by the removal of water and moisture from the insulation layer via said plurality of openings and said first and second pluralities of grooves.

18. A ventilation system according to claim 17, wherein said protective means comprises a rigid panel.

19. A ventilation system according to claim 17, further comprising a fireproof member disposed between said basic structure and said vapor barrier.

20. A ventilation system according to claim 17, wherein the membrane is composed of layers of felt.

21. A ventilation system according to claim 20, wherein the layers of felt are secured together by means of an adhesive.

22. A ventilation system according to claim 17, wherein said sheet comprises at least one closed-cell expanded plastic sheet.

23. A ventilation system according to claim 17, wherein said aeration outlet means includes at least one peripheral opening located on a periphery of said sheet.

24. A ventilation system according to claim 17, wherein said sheet has a plurality of supports arranged between the openings.

25. A ventilation system according to claim 24, wherein said sheet and said supports are unitary.

26. A ventilation system according to claim 17, wherein said sheet is constructed from an impermeable material.

27. A ventilation system according to claim 17, wherein said membrane comprises an impermeable membrane.

28. A ventilation system according to claim 17, wherein said insulation layer comprises at least one inorganic mineral fiber panel.

29. A ventilation system according to claim 17, wherein said insulation layer comprises a vapor barrier.

* * * * *